US009685269B2

(12) United States Patent
Elie et al.

(10) Patent No.: US 9,685,269 B2
(45) Date of Patent: Jun. 20, 2017

(54) METHOD OF FORMING AN INSULATED ELECTRIC CONDUCTOR

(71) Applicant: Ford Global Technologies, LLC, Dearborn, MI (US)

(72) Inventors: Larry Dean Elie, Ypsilanti, MI (US); Allan Roy Gale, Livonia, MI (US); John Matthew Ginder, Plymouth, MI (US); Clay Wesley Maranville, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 685 days.

(21) Appl. No.: 13/654,579

(22) Filed: Oct. 18, 2012

(65) Prior Publication Data

US 2014/0110148 A1 Apr. 24, 2014

(51) Int. Cl.

| | |
|---|---|
| ***H01R 43/00*** | (2006.01) |
| ***H01F 41/12*** | (2006.01) |
| ***H01F 5/02*** | (2006.01) |
| ***H01F 41/064*** | (2016.01) |

(52) U.S. Cl.

CPC ..... *H01F 41/127* (2013.01); *H01F 5/02* (2013.01); *H01F 41/064* (2016.01)

(58) Field of Classification Search

CPC Y10T 29/49117; H02G 1/1256; H01B 3/105; A61N 1/056

USPC ..... 29/825; 174/110 A, 126.1

See application file for complete search history.

(56) References Cited

U.S. PATENT DOCUMENTS

| | | | | |
|---|---|---|---|---|
| 5,057,651 | A * | 10/1991 | Hope et al. | 174/107 |
| 5,091,609 | A * | 2/1992 | Sawada et al. | 174/110 A |
| 5,300,733 | A * | 4/1994 | Uematsu | 174/106 SC |
| 5,336,851 | A * | 8/1994 | Sawada et al. | 174/110 A |
| 5,372,886 | A * | 12/1994 | Inazawa et al. | 428/384 |
| 7,572,980 | B2 * | 8/2009 | Elie et al. | 174/110 A |
| 2009/0271977 | A1 * | 11/2009 | Elie et al. | 29/825 |

* cited by examiner

*Primary Examiner* — Paul D Kim
(74) *Attorney, Agent, or Firm* — LeClairRyan

(57) ABSTRACT

A method of anodizing a coil comprised of wire having a copper core and a layer of a metal formed on the core is disclosed. The metal has electrically insulating characteristics when anodized. Two variations of the method are provided. In the first variation, the metal-clad wire is partially anodized prior to being wound on a spool to form a coil. Once the partially anodized wire is wound onto a spool the coiled wire is anodized to complete anodization. The anodized coiled wire may be rinsed to remove residual electrolytic material. In the second variation, the metal-clad wire is wound on a spool to form a coil. The coiled wire is then anodized. The method of the disclosed invention reduces or entirely eliminates the presence of micro cracks in the oxide layer. The resulting coil may be used in motors, electromagnets, generators, alternators and subsystems for the same.

12 Claims, 5 Drawing Sheets

METHOD OF FORMING AN INSULATED ELECTRIC CONDUCTOR

TECHNICAL FIELD

The disclosed invention relates generally to an anodized coil for use in electric motors, relays, solenoids electromagnets and the like. More particularly, the disclosed invention relates to an anodize coil having a copper core and an anodized metallic dielectric layer formed partially or entirely after the coil is formed.

BACKGROUND OF THE INVENTION

The insulation of electrically conductive wire used to form a coil or similar conductive article is generally established and may be undertaken by a number of methods, including coating the wire with an organic polymerized material. According to this approach, any one of several organic wire coatings selected from the group consisting of plastics, rubbers and elastomers will provide effective insulation on conductive material. Today most if not all electromagnetic coils use polymeric insulated wire.

However, while these materials demonstrate good dielectric properties and have the ability to withstand high voltages, they are compromised by their poor operating performance at temperatures above 220° C. as well as by their failure to effectively dissipate ohmic or resistance heating when used in coil windings. (Inorganic insulation such as glass, mica or certain ceramics, tolerates temperatures greater than 220° C. but suffer from being too brittle for most applications.)

In addition to coating conductive material with an organic substance, electrically conductive materials such as copper and aluminum may be anodized to provide some measure of insulation. In the case of a copper core, the anodization of this material is known to produce unsatisfactory results due to cracking. It is possible to electroplate copper with aluminum but this approach generally produces undesirable results in terms of durability of the coating. In the case of an aluminum core, copper can be plated on the core but results in unsatisfactory electrical efficiency.

An electrically insulated conductor for carrying signals or current having a solid or stranded copper core of various geometries with only a single electrically insulating and thermally conductive layer of anodized aluminum (aluminum oxide) is disclosed in U.S. Pat. No. 7,572,980. As described in the '980 patent, the device is made by forming uniform thickness thin sheet or foil of aluminum to envelop the copper conductive alloy core. The aluminum has its outer surface partially anodized either before or after forming to the core in an electrolytic process to form a single layer of aluminum oxide.

While the above-described developments represent advancements in the art of insulating wires, there remains room in the art for further advancement. For example, the known approaches are challenged by the oxide layer being scratched or cracked when wound on a spool to form the coil if the wire is fully anodized prior to the step of winding.

SUMMARY OF THE INVENTION

The disclosed invention advances electric conductor technology and overcomes several of the disadvantages known in the prior art. Particularly, the disclosed invention provides a method of anodizing a wire having a copper core and a layer of a metal such as aluminum formed on the copper core wherein the wire is either partially or entirely anodized after the wire has been coiled onto a spool. Aluminum demonstrates good electrical insulating properties when anodized. While aluminum is a preferred metal for layering over the copper core according to the disclosed invention, other non-limiting examples of metals that also demonstrate electrical insulating properties when anodized include titanium, zinc and magnesium. Such metals may alternatively be formed over the copper core. The step of anodizing, whether partially undertaken before winding and completed after winding or undertaken entirely after winding, results in a dielectric layer of a metallic oxide (such as aluminum oxide) overcoating the copper core. The dielectric layer electrically insulates the copper core while being thermally conductive to dissipate heat generated due to normal operations. The copper core may be a solid core or may be formed from a plurality of copper strands.

According to a first variation of the method of the disclosed invention, the metal-clad wire is partially anodized prior to being wound on a spool to form a coil. The partially anodized wire may be rinsed to remove residual electrolytic material prior to winding. The rinsed wire may also be annealed prior to winding. Once the partially anodized wire is wound onto a spool to form a coil, the coiled wire is then anodized to complete the anodization process. The coiled wire may be rinsed to remove residual electrolytic material. Annealing may follow.

According to a second variation of the method of the disclosed invention the metal-clad wire is wound on a spool to form a coil. The coiled wire is then anodized. Once fully anodized, the coiled wire may be rinsed to remove residual electrolytic material. Annealing may follow the rinse.

By forming a coil by either of the above-discussed variations of the method of the disclosed invention the presence of micro cracks in the oxide layer can be reduced or entirely eliminated. A wire having a reduced number of micro cracks or no micro cracks according to the method of the disclosed invention may be useful in a broad variety of applications where coiled wire or similar conductive material is required, such as for vehicle generators, alternators and for subsystems related to generators, alternators and regulators. Accordingly, the disclosed invention may be useful in the manufacture of both internal combustion vehicles as well in hybrid vehicles and systems for hybrid vehicles. Furthermore, the disclosed invention may find application in electromagnets and in any electrical motor that requires effective heat dissipation and that operates under a high temperature. Accordingly, the disclosed invention may find application in the locomotive and aerospace industries as well as in the automotive vehicle industry.

These and other advantages and features of the disclosed invention will be readily apparent from the following detailed description of the preferred embodiments when taken in connection with the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention wherein.

Figure 3:
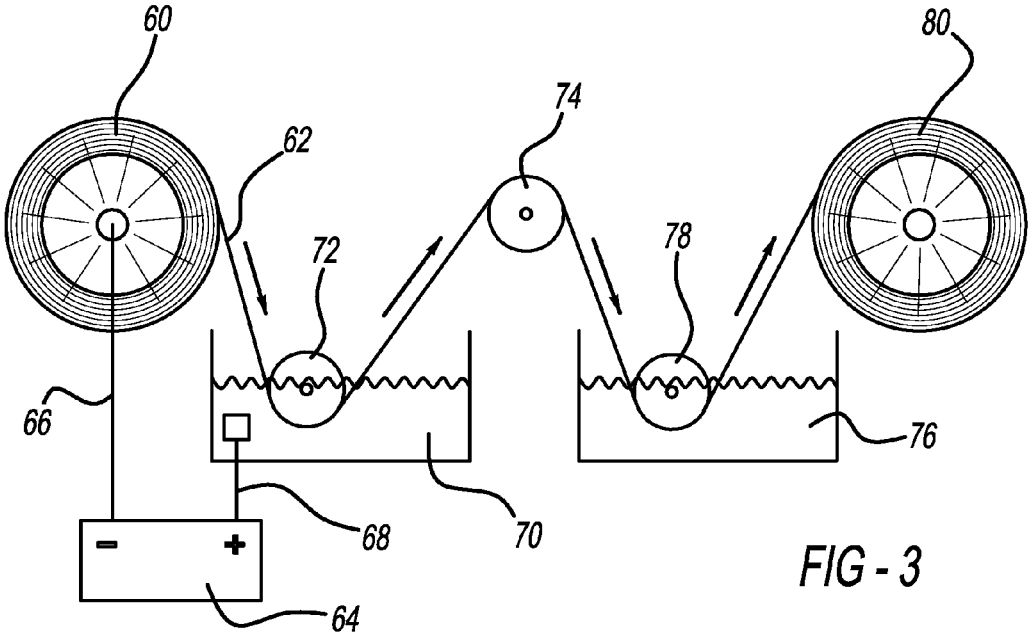
Figure 4:
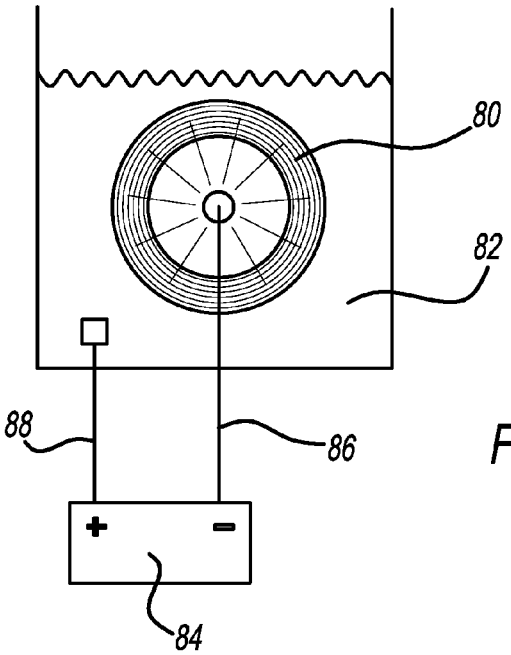
Figure 5:
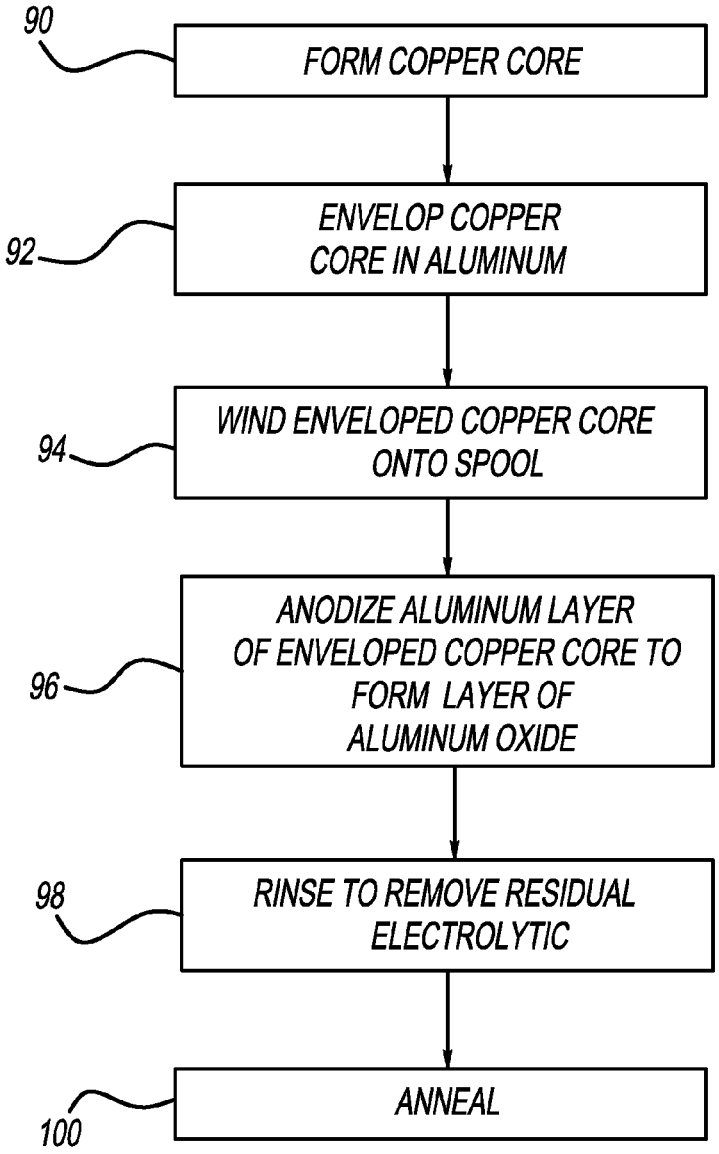
Figure 6:
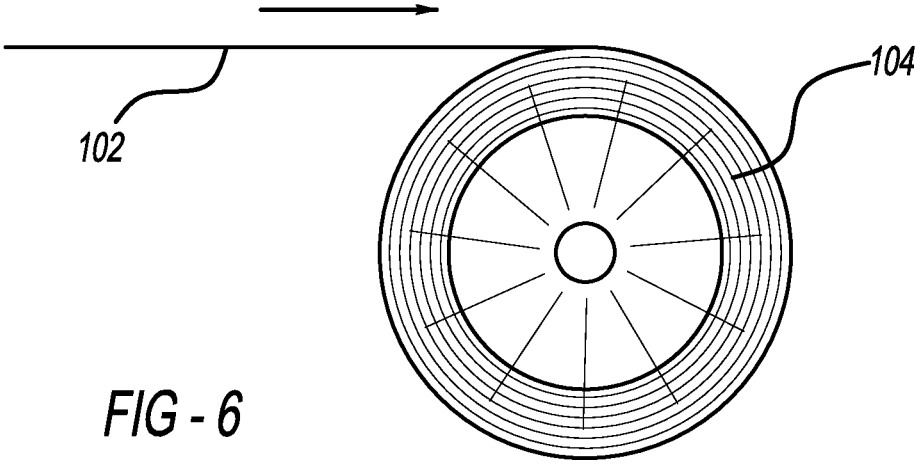
Figure 7:
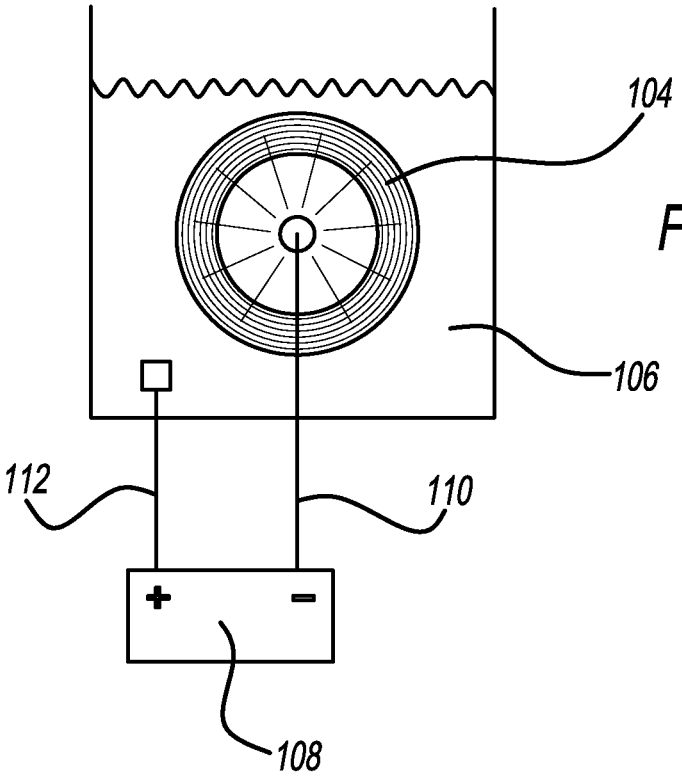

1A-1D wherein the wire is partially anodized prior to the step of coiling the wire on a spool according to the disclosed invention;

FIG. 3 is a graphical representation of a continuous process for partially anodizing the metal-coated copper wire followed by the steps of rinsing then winding the partially anodized wire onto a spool according to the first variation of the method of the disclosed invention;

FIG. 4 is a graphical representation of the step of completing the anodizing of the wire, now on a spool, begun in the step shown in FIG. 3 according to the first variation of the method of the disclosed invention;

FIG. 5 is a flow chart describing a second variation of the method for anodizing a wire for a coil shown in FIGS. 1A-1D wherein the wire is fully anodized after the step of coiling the wire on a spool according to the disclosed invention;

FIG. 6 is a graphical representation of a process for winding a wire for a coil shown in FIGS. 1A-1D onto a spool prior to the step of anodizing; and FIG. 7 is a graphical representation of the step of anodizing wire wound onto the spool of FIG. 6 according to the second variation of the method of the disclosed invention.

DETAILED DESCRIPTION OF THE PREFERRED EMBODIMENT

In the following figures, the same reference numerals will be used to refer to the same components. In the following description, various operating parameters and components are described for different constructed embodiments. These specific parameters and components are included as examples and are not meant to be limiting.

With respect to FIGS. 1A through 1D, sectional views of wires having a copper core and overcoated with a metal, such as aluminum, as used in the disclosed invention are illustrated. While aluminum is preferred for layering over the copper core because of its good electrical insulating characteristics when anodized, other metals may also be used. Such metals include, without limitation, titanium, zinc and magnesium. The illustrated shapes and thickness of the layers are only suggestive and are not intended as being limiting. The metal-covered copper wires are preferably although not necessarily formed according to the methods and materials set forth in the above-discussed U.S. Pat. No. 7,572,980 and incorporated by reference in its entirety herein. The '980 patent is assigned to the same assignee to which the disclosed invention is assigned.

Figure 1A:
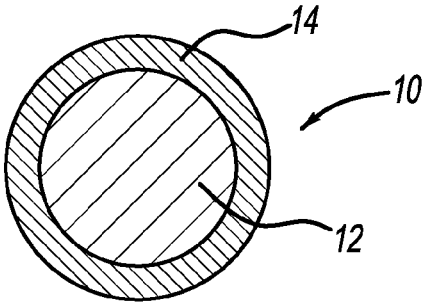
FIGS. 1A-1D are sectional views of wires illustrated after being overcoated with a layer of a metal.

With particular reference to FIG. 1A, a sectional view of a wire, generally illustrated as 10, is shown. The wire 10 includes a copper or copper alloy core 12 and a metal layer 14. As set forth in the '980 patent, the metal layer 14 is formed by enveloping the copper core 12 with a uniform thickness thin sheet of metal.

Figure 1B:
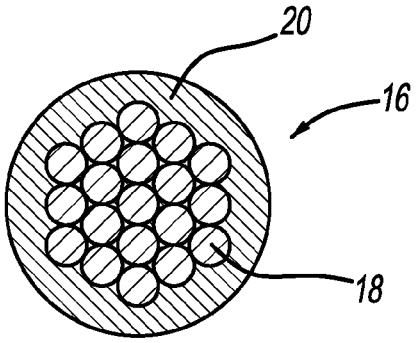

Referring to FIG. 1B, a sectional view of an alternate embodiment of the wire, generally illustrated as 16, is shown. The wire 16 includes a copper or copper alloy core 18 formed from a plurality of independent copper or copper alloy strands. The wire 16 further includes a metal layer 20.

Figure 1C:
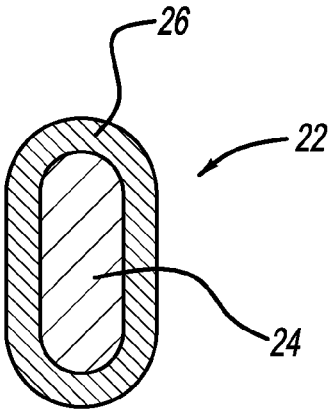
Figure 1D:
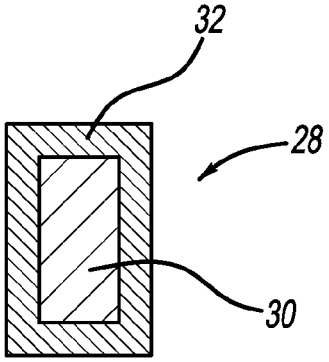

FIGS. 1C and 1D illustrate variations in the shape of the wire for use in the disclosed invention. With reference first to FIG. 1C, a sectional view of a wire is generally illustrated as 22. The wire 22 includes a generally flat copper or copper alloy core 24. The wire 22 further includes a metal layer 26.

With reference to FIG. 1D, a sectional view of an additional variation of the wire is generally illustrated as 28. The wire 28 includes a generally rectangular copper or copper alloy core 30. The wire 70 includes a metal layer 32.

Figure 2:
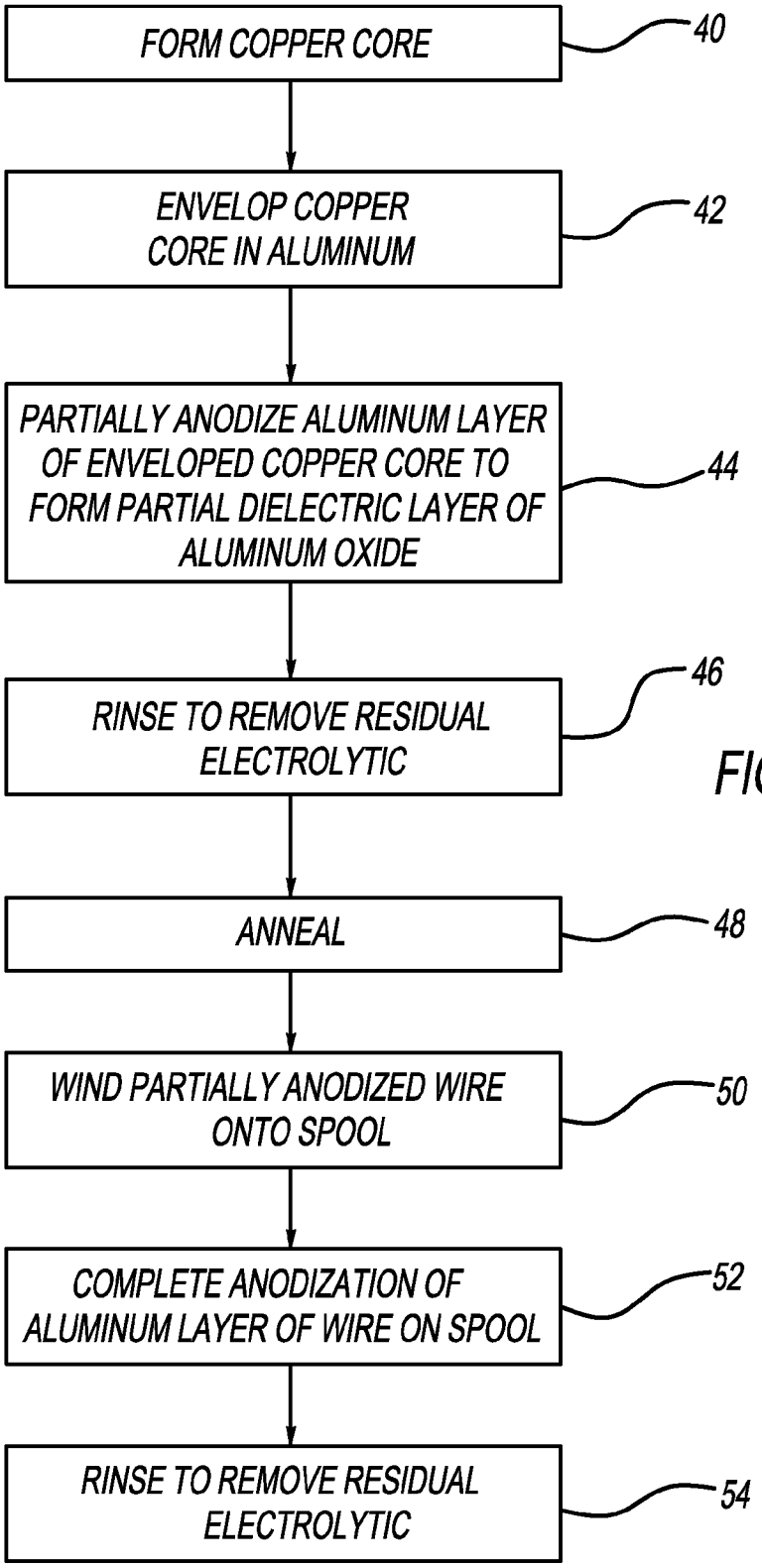
FIG. 2 is a flow chart describing a first variation of the method for anodizing a wire for a coil shown in FIGS.

Regardless of the size or shape, and to this end it is to be understood that the shapes of the wire illustrated in FIGS. 1A through 1D are intended as being illustrative and non-limiting, the wire is to be wound onto a spool to form a coil. The wire forming the coil may be partially anodized prior to winding followed by anodization or may be anodized once coiled as disclosed above. FIGS. 2 through 4 relate to the first variation of the method for anodizing wire for a coil shown in FIGS. 1A through 1D, that of partially anodizing the wire prior to winding followed by further anodization. FIGS. 5 through 7 relate to the second variation of the method for anodizing wire for a coil shown in FIGS. 1A through 1D, that of only anodizing the wire once it has been coiled.

Referring to FIG. 2, a flow chart describing the first variation of the method is shown. At the first step 40 the copper core is formed. As set forth above with respect to FIGS. 1A through 1D, the copper core may be solid or may be composed of multiple strands. Furthermore the copper core may be copper or copper alloy. Once the copper core is formed, the copper core is enveloped in a thin sheet or foil of a metal such as aluminum at step 42. Particularly, and as set forth in the '980 patent, at step 42 the copper core (12, 18, 24, 30) is enveloped in a thin sheet of metal (14, 20, 26, 32). One or more thin sheets of the metal may be used depending on desired core geometry or other parameters. The metal sheet may be applied by any technique including but not limited to mechanical cold-forming techniques, co-extrusion techniques, vacuum welding, or RF bonding or any combination thereof.

Once the metal layer, for example an aluminum layer, envelops the copper core at step 42 the outer surface of the metal is partially anodized at step 44. This is done using an electrolytic process to form a single homogeneous dielectric layer. The step of partially anodizing the metal layer may be undertaken before being applied to the copper core.

At step 46 the anodized metal may be rinsed according to an optional step of the disclosed invention. Rinsing of the anodized metal stops the anodization process by removing the electrolytic solution.

A further optional step arises at step 48 in which the conductor, now a composite, is annealed. The annealing process reduces or eliminates stresses that may be present in the core, the metal layer, the dielectric metallic oxide layer, or between layers.

Once the metal layer has been anodized and optionally rinsed and annealed the partially-anodized wire is wound onto a spool to form a coil at step 50. Any one of several coils may be formed by this process.

After being wound to form a coil on a spool, the wire is anodized again to substantially or entirely complete the process of forming the oxide layer. This occurs at step 52.

At step 54 the anodized wire is again optionally rinsed to remove any residual electrolytic fluid and to thus fully halt the anodization process. The rinsed coil may optionally be annealed thereafter.

As noted, at step 44 the wire is partially subjected to anodization to form a partial dielectric layer of metallic oxide, such as aluminum oxide where aluminum is used. Referring to FIG. 3, a graphical representation of a continuous process for partially anodizing the metal layer of the wire is illustrated. Particularly, a supply or feed roll 60 having a continuous length of wire 62 is provided. The wire 62 has a copper or copper alloy core (12, 18, 24, 30) and is enveloped in a thin sheet of metal (14, 20, 26, 32). A power supply 64 has a negative terminal 66 connected to either the roll 60 or the wire 62. The positive terminal 68 of the power supply 64 is also provided and is connected to an electrolyte solution 70. The electrolyte solution 70 provides a bath for the wire 62.

At least partially submerged in the electrolyte solution 70 is a guide roller 72. The guide roller 72 guides the wire 62 into and out of the solution 70. The voltage across the terminals 66 and 68 causes an electric current to run through the solution 70, thereby causing a chemical reaction of the solution 70 with the outer surface of the metal. The reaction results in the formation of a partial dielectric layer of metallic oxide. By regulating such parameters as rate of travel of the wire 62 through the solution 70, current strength in the solution 70, and the density of the solution 70 the anodization process can be controlled and the amount of dielectric layer formed can be restricted to partial anodization.

Another guide roller 74 is provided to guide the partially anodized wire 62 out of the solution 70. At this point the wire 62 may optionally pass through a rinse 76 to remove any remaining electrolyte solution. A guide roller 78 guides the partially anodized wire 62 through the rinse 76. The rinsed wire 62 is taken up on a spool to form a coil 80. The illustrated coil 80 is only suggested and is not intended as being limiting.

As illustrated in FIG. 4, the partially anodized wire on the coil 80 is then introduced into a second electrolyte solution 82. A power supply 84 having a negative terminal 86 is connected to either the coil 80 or the wire 62. A positive terminal 88 of the power supply 84 is also provided and is connected to an electrolyte solution 82. The electrolyte solution 82 provides a bath for the wire 62 coiled on the coil 80.

Once the anodization process is completed, the coil 80 may be rinsed to remove residual electrolytic solution followed by optional annealing.

Referring to FIG. 5, a flow chart describing the second variation of the method of the disclosed invention is shown. At the first step 90, the copper core is formed. Again as set forth above with respect to FIGS. 1A through 1D, the copper core may be solid or may be composed of multiple strands. Furthermore, the copper core may be copper or copper alloy. Once the copper core is formed, the copper core is enveloped in a thin sheet or foil of a metal, such as aluminum, at step 92. Again as set forth in the '980 patent, at step 42 the copper core (12, 18, 24, 30) is enveloped in a thin sheet of metal (14, 20, 26, 32). One or more thin sheets of the metal may be used depending on desired core geometry or other parameters. The metal sheet may be applied by any technique including but not limited to mechanical cold-forming techniques, co-extrusion techniques, vacuum welding, or RF bonding or any combination thereof.

Once the metal layer envelops the copper core at step 92 the wire is taken up on a spool to form a coil at step 94. Any one of several coils may be formed by this process.

After the wire is wound to form a coil on a spool, the wire is anodized to form the metallic oxide layer on the formed wire. This occurs at step 96.

At step 98 the anodized wire is again optionally rinsed to remove any residual electrolytic fluid and to thus fully halt the anodization process. The rinsed coil may optionally be annealed thereafter at step 100.

As noted, at step 94 the wire is wound on a spool to form a coil. Referring to FIG. 6, a graphical representation of a process for winding a continuous length of wire 102 onto a spool to form a coil 104 is illustrated. The illustrated coil 104 is only suggested and is not intended as being limiting.

As illustrated in FIG. 7, the coil 104 is introduced into an electrolyte solution 106. A power supply 108 has a negative terminal 110 connected to either the coil 104 or the wire 102. A positive terminal 112 of the power supply 108 is also provided and is connected to the electrolyte solution 106. The electrolyte solution 106 provides a bath for the wire 102 coiled on the coil 104.

Once the anodization process is completed, the coil 104 may be rinsed to remove residual electrolytic solution followed by optional annealing.

The foregoing discussion discloses and describes exemplary embodiments of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. A method of forming an insulated electric conductor comprising the steps of:

forming a copper core;

substantially enveloping said copper core in a layer of a metal having electrically insulating characteristics when anodized;

winding the metal-layered copper core onto a spool to form a coil;

after winding, anodizing at least some of said layer of metal with electrolytic material to form a metallic oxide dielectric layer; and after the anodizing step, rinsing the anodized metal to remove residual electrolytic material.

2. The method of forming an insulated electric conductor according to claim 1, further comprising the step of annealing following the rinsing step.

3. The method of forming an insulated electric conductor according to claim 1, further comprising the step of partially anodizing at least some of said layer of metal to form a metallic oxide dielectric layer prior to said step of winding.

4. The method of forming an insulated electric conductor according to claim 3, further comprising the step of annealing following the step of rinsing after said partial anodizing step.

5. The method of forming an insulated electric conductor according to claim 3 wherein the copper core comprises a plurality of discrete copper strands.

6. The method of forming an insulated electric conductor according to claim 1 wherein said metallic oxide dielectric layer comprises a substantially homogeneous layer of metallic oxide.

7. The method of forming an insulated electric conductor according to claim 1 wherein said layer of metal disposed on said copper core is a metal sheet that is mechanically formed onto said copper core.

8. The method of forming an insulated electric conductor according to claim 1 where said metal is selected from the group consisting of aluminum, titanium, zinc and magnesium.

9. A method of forming an electric coil comprising the steps of:

forming a copper core;

substantially enveloping said copper core in a layer of a metal having electrically insulating characteristics when anodized;

winding the metal-layered copper core onto a spool to form a coil;

after the winding step, anodizing at least part of said layer of metal with electrolytic material to form a metallic oxide dielectric layer; and after the anodizing step, rinsing the anodized metal to remove residual electrolytic material.

10. The method of forming an insulated electric conductor according to claim 9, further comprising the step of annealing following the rinsing step.

11. The method of forming an insulated electric conductor according to claim 9 where said metal is selected from the group consisting of aluminum, titanium zinc and magnesium.

12. A method of forming an electric coil comprising the steps of:

forming a copper core;

substantially enveloping said copper core in a layer of a metal having electrically insulating characteristics when anodized;

initially anodizing part of said layer of metal with electrolytic material to form a metallic oxide dielectric layer;

after the initial anodizing step, rinsing the anodized metal to remove residual electrolytic material;

winding the partially-oxidized metal-layered copper core onto a spool to form a coil;

after winding, further anodizing said layer of metal with electrolytic material to complete the anodization on said spool; and after the second anodizing step, rinsing the anodized metal to remove residual electrolytic material.

* * * * *